US006928658B2

(12) United States Patent
Taira et al.

(10) Patent No.: US 6,928,658 B2
(45) Date of Patent: Aug. 16, 2005

(54) VIBRATION-PROOF GLOVE AND PRODUCTION METHOD THEREOF

(75) Inventors: Souichirou Taira, Takehara (JP); Tatsuo Kashihara, Takehara (JP)

(73) Assignee: Atom Corporation, Takehara (JP)

( * ) Notice: Subject to any disclaimer, the term of this patent is extended or adjusted under 35 U.S.C. 154(b) by 0 days.

(21) Appl. No.: 10/813,791

(22) Filed: Mar. 31, 2004

(65) Prior Publication Data

US 2004/0226074 A1 Nov. 18, 2004

(30) Foreign Application Priority Data

May 14, 2003 (JP) ..... 2003-136140

(51) Int. Cl.[7] ..... A41D 19/00
(52) U.S. Cl. ..... 2/161.6
(58) Field of Search ..... 2/16, 20, 158, 2/159, 160, 161.1, 161.2, 161.6, 163, 164, 167, 168; 602/21

(56) References Cited

U.S. PATENT DOCUMENTS 5,214,799 A * 6/1993 Fabry ..... 2/161.6
5,257,418 A * 11/1993 Jaskiewicz ..... 2/20
5,500,956 A * 3/1996 Schulkin et al. ..... 2/161.1
5,537,688 A * 7/1996 Reynolds et al. ..... 2/20
5,557,803 A * 9/1996 Granich et al. ..... 2/16
5,632,045 A * 5/1997 Chase et al. ..... 2/161.6
5,675,839 A * 10/1997 Gordon et al. ..... 2/159
6,202,217 B1 3/2001 Karall
6,425,134 B1 * 7/2002 Huang ..... 2/20
6,618,860 B1 9/2003 Sullivan et al.
6,723,401 B1 4/2004 McKnight et al.

FOREIGN PATENT DOCUMENTS

JP 1-292106 A 11/1989
JP 10-053908 2/1998
JP 2001-303332 A 10/2001
JP 2001-336007 A 12/2001
JP 2002-013014 A 1/2002
JP 2002-201515 7/2002
JP 2002-266130 A 9/2002
WO WO 01/13748 A1 3/2001

* cited by examiner

*Primary Examiner*—Gary L. Welch
(74) *Attorney, Agent, or Firm*—Frishauf, Holtz, Goodman & Chick, P.C.

(57) ABSTRACT

There is provided a vibration-proof glove which is wore particularly in an operation with a vibration tool such as a rock drill or engine cutter. The vibration-proof glove comprises a stretchy glove body 1 made of such as a knit material, and a vulcanized foam rubber 2 provided at least on the palm portion of the globe body. A plurality of crosswise grooves 2*a* or lengthwise grooves 2*b* are provided on the palm portion of the glove. The vulcanized foam rubber material 2 may be formed with chloropylene rubber or natural rubber.

2 Claims, 4 Drawing Sheets

VIBRATION-PROOF GLOVE AND PRODUCTION METHOD THEREOF

BACKGROUND OF THE INVENTION

1. Field of the Invention

This invention relates to a vibration-proof glove which is excellently effective in vibration absorption, simple in structure, low in production cost and easy to use.

2. Description of the Prior Art

Conventionally, vibration-proof gloves have been used in order to protect bodies of users from high vibrations during operations with so called vibration tools e.g., a rock drill or engine cutter.

There are many types in vibration-proof gloves. For example, there is a type that a hollow or tube is provided in the palm portion of a glove, a type that air is filled in a glove when used, and a type that a insulation material is provided to a glove. See, for example, Japanese Unexamined Patent Publication No. 10-053908, Japanese Unexamined Patent Publication No. 2001-336007 and Japanese Unexamined Patent Publication No. 2002-013014.

By wearing the above-mentioned vibration-proof gloves, high vibrations are restrained from directly traveling to the palms of users so that the users are protected from impact shocks.

However, there are drawbacks in the prior arts that those of the conventional gloves are complex in structure, high in production cost and uneasy to use.

For example, according to the glove provided with a hollow, it is difficult to precisely form the hollow at a specific portion of the glove. Further, the hollow is broken by high vibrations and thus the usability of the glove is likely to decrease. In other conventional gloves provided with a tube, filled with air and provided with a vibration insulation have similar drawbacks. Further, those prior gloves are required to fasten an extra member such as a tube, pump for filling air or a vibration-insulation material, so that they are more complex in structure.

Therefore, it is an object of this invention to provide a vibration-proof glove which is excellent in reducing vibrations, simple in structure, low in production cost and easy to use. It is another object of this invention to provide a production method of such vibration-proof glove.

SUMMARY OF THE INVENTION

In order to resolve the above-mentioned drawbacks, a vibration-proof glove according to a first aspect of the invention is provided that is worn particularly in an operation with a vibration tool as a rock drill or engine cutter. The vibration-proof glove comprises a stretchy glove body (1) made of knit and the like, and a vulcanized foam rubber (2) provided at least on the palm portion of the glove body.

Further, according to a second aspect of the invention a plurality of crosswise grooves **(2*a*) are provided on the palm portion of the glove in a direction roughly orthogonal to the direction the finger portions of the glove are extending. It will be noted that the crosswise groove (2*a*)** in other words is a groove provided on the palm portion along the crosswise direction of the palm.

Further, according to a third aspect of the invention a plurality of lengthwise grooves **(2*b*)** are provided on the palm portion of the glove in a direction roughly parallel to the direction the finger portions of the glove are extending.

It will also be noted that the lengthwise groove **(2*b*)** is in other words a groove provided on the palm portion along the lengthwise direction of the palm.

Moreover, according to a fourth aspect of the invention the vulcanized foam rubber (2) is made of chloropylene rubber or natural rubber.

According to a fifth aspect of the present invention, a method is performed for producing a vibration-proof glove which is worn particularly in an operation with a vibration tool e.g., a rock drill or engine cutter. The production method comprises at least a first to sixth processes. In a first process, a rubber sheet (3) is produced with materials comprising a rubber material such as chloropylene rubber or natural rubber and a foaming agent added into the rubber material. In a second process, the rubber sheet (3) is cut into a given size. In a third process, a stretchy glove body (1) made of knit and the like is mounted over a flat hand shape mold (4), followed by setting the glove body (1) with the flat hand shape mold (4) in a lower mold **(6*b*) wherein the palm portion of the glove body (1) is placed upward. In a fourth process, the rubber sheet (3) is placed on the palm portion of the glove body (1), followed by press heating the rubber sheet (3) by an upper mold (6*a*) from above to attach the rubber sheet (3) to the glove body (1). In a fifth process, the glove body (1) is removed from the flat hand shape mold (4), and is mounted over a tridimensional hand shape mold (5). And in a sixth process, the rubber sheet (3) is vulcanized and foamed by being heated to increase the thickness of the rubber sheet (3)**.

Further, a production method of a vibration-proof glove according to a sixth aspect of the invention is applied with an upper mold which comprises a plurality of patterns of crosswise grooves and/or lengthwise grooves on a side thereof which is used to press and heat the rubber sheet (3).

It will be noted that each numeral in a parenthesis indicates a corresponding element or matter mentioned in the drawings and preferred embodiment of the invention described hereinafter.

According to the first aspect of the invention, a vulcanized foam rubber material is provided at least at the palm portion of a stretchy glove body made of knit and the like, so that an excellently high vibration insulation effect can be obtained by the vulcanized foam rubber material which functions as a vibration insulation material.

Further, the glove is composed merely of the glove body and the vulcanized foam rubber material, so that the glove is simple in structure and the production cost thereof is low. Moreover, the vulcanized and foamed rubber material is flexible, thus it is easy to move a hand wearing the glove and is excellent in usability.

According to the second aspect of the invention, which includes the similar effects of the first aspect of the invention, a plurality of crosswise grooves are provided on the vulcanized foam rubber material, so that the flexibility of the vulcanized foam rubber material can be improved. Therefore, the usability of the glove further improves.

According to the third aspect of the invention, which includes the similar effects of the first or second aspect of the inventions, a plurality of lengthwise grooves are provided on the vulcanized foam rubber material, so that the flexibility of the glove is further improved, thereby improving the usability of the glove.

According to the fourth aspect of the invention, which includes the similar effects of the first, second and third aspects of the inventions, when the vulcanized foam rubber material is made particularly of chloropylene rubber, a clean skin layer can be formed on the surface of the rubber material at a time of vulcanization and foaming.

According to the production method of a vibration-proof glove in the fifth aspect of the invention, the glove is produced merely by forming a rubber sheet with rubber material, which includes chloropylene rubber, natural rubber and the like, and a foaming agent which is added into the rubber material, followed by vulcanizing and foaming the rubber sheet after attaching the rubber sheet on a glove body, so that a vibration-proof glove can be easily produced.

According to the sixth aspect of the invention, which includes the effect of the fifth aspect of the invention, the vulcanized and foamed rubber material is provided with either a plurality of the crosswise grooves or lengthwise grooves, or it is provided with both the crosswise grooves and the lengthwise grooves, so that the flexibility of the glove improves by the effects of those grooves, thereby improving the usability of the glove.

DESCRIPTION OF PREFERRED EMBODIMENT

Figure 1:
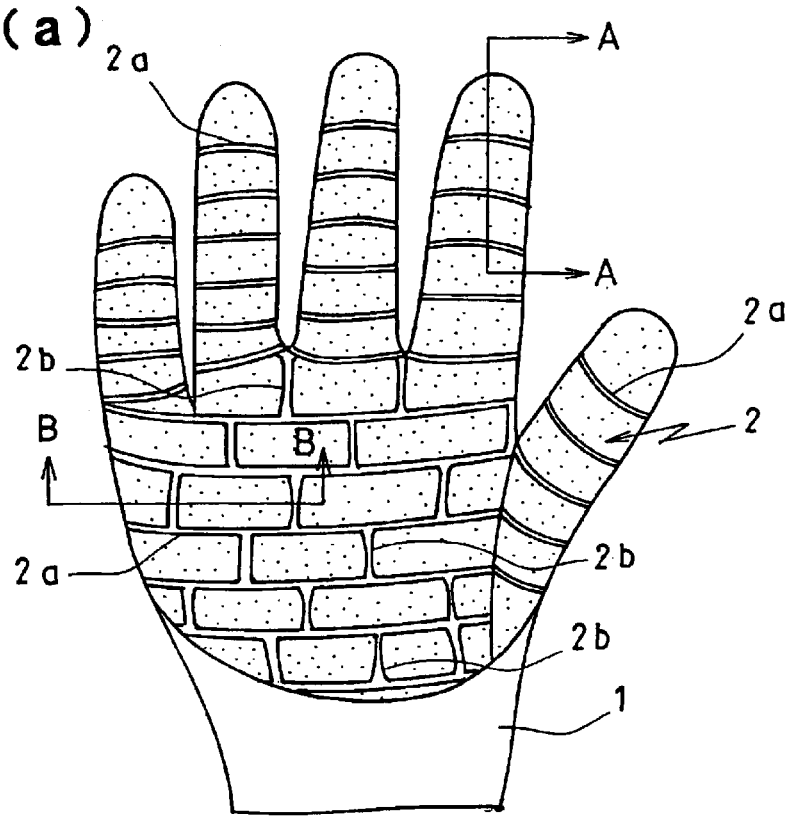
FIG. 1 is a vibration-proof glove according to a preferred embodiment of the invention wherein the numeral (a) illustrates an elevation view of the palm portion of the glove, the numeral (b) illustrates an elevation view of the back portion of the glove.
Figure 1:
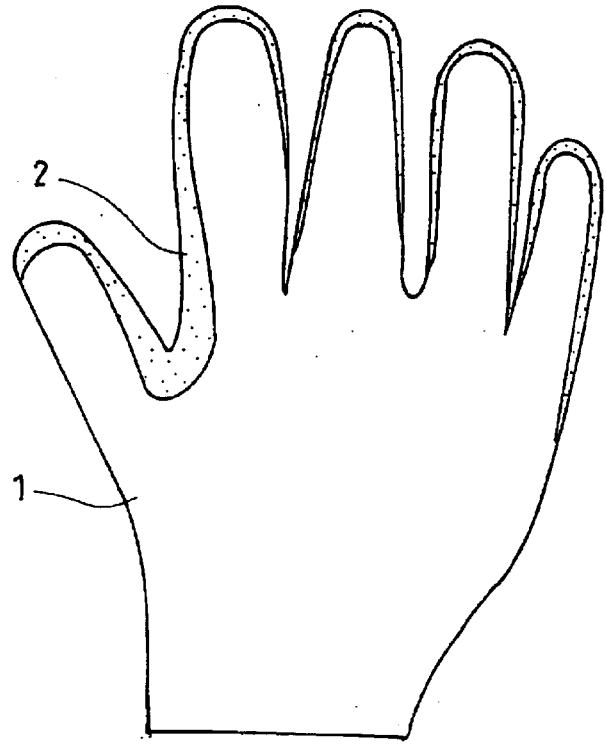
Figure 2:
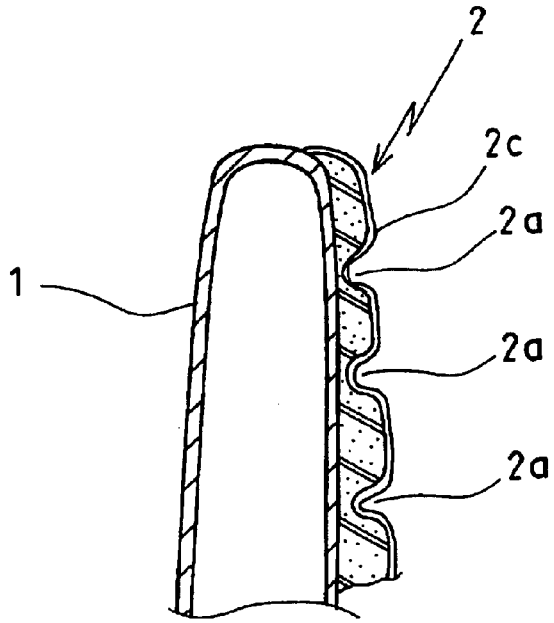
FIG. 2 is an enlarged section view along A—A line in FIG. 1 (*a*).
Figure 3:
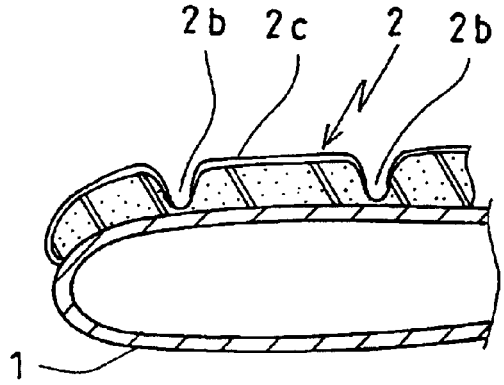
FIG. 3 is an enlarged section view along B—B line in FIG. 1 (*a*).

A vibration-proof glove according to the invention is described hereinafter referring to FIGS. 1 to 3. FIG. 1 illustrates a vibration-proof glove wherein the numeral (a) shows an elevation view of the palm portion of the glove while the numeral (b) showing an elevation view of a back portion of the glove. FIG. 2 illustrates an enlarged section view along line A—A in FIG. 1 (*a*). FIG. 3 illustrates an enlarged section view along line B—B in FIG. 1 (*a*).

A vibration-proof glove according to a preferred embodiment of the invention is wore in an operation with a vibration tool including a rock drill, engine cutter and the like. The glove comprises a knit made glove body 1 with high stretch property and a vulcanized foam rubber material 2 made of chloropylene rubber which is provided on the palm portion of the glove body 1 (the rubber material 2 can be made of natural rubber instead of chloropylene).

There are formed a plurality of crosswise grooves 2*a* throughout the palm portion of the vulcanized foam rubber material 2. Further, a plurality of lengthwise grooves 2*b* are formed on the palm portion, excluding the finger portions, in a direction roughly orthogonal to the direction the finger portions of the glove are extending. The plurality of the crosswise grooves 2*a* are formed on the vulcanized and foamed rubber material 2 in a direction roughly orthogonal to the direction the finger portions of the glove are extending, while the plurality of the lengthwise grooves 2*b* are formed in a direction roughly parallel to the direction the finger portions of the glove are extending.

It will be noted that the glove body 1 in the vibration-proof glove according to this preferred embodiment of the invention is made of knit though it is not critical and it may be made of other stretchy materials.

Further, although both the crosswise grooves 2*a* and the lengthwise grooves 2*b* are formed on the vulcanized and foamed rubber material 2 in this embodiment, either one type of the grooves may be provided. Moreover, the grooves 2*a*, 2*b* may be formed in oblique directions.

According to the vibration-proof glove in this embodiment, the vulcanized and foamed rubber sheet material 2 fulfills the role of a vibration insulation material, thereby restraining hard vibrations from traveling to a human hand, and performing a high quality of vibration proof effect.

Further, the vibration-proof glove is made merely with a glove body 1 and a vulcanized foam rubber material 2, so that it is simple in structure and it can restrain a production cost in low price.

Moreover, the vulcanized foam rubber material 2 is very flexible, so that it enables a hand wearing the glove to move freely and that the usability of the glove is good. In particular, the vulcanized foam rubber material 2 is provided with a plurality of the crosswise grooves 2*a* and lengthwise grooves 2*b*, so that the flexibility of the glove is highly improved and that the usability of the glove is excellent.

For those reasons, when a vibration tool such as a rock drill, for example, is handled, an operation of the vibration tool becomes easier because the glove is easily bent and stretched associating with movements of the human hand wearing the glove.

It will be noted that the vulcanized foam rubber material 2 of the vibration-proof glove is made of chloropylene rubber (and foaming agent), so that it is possible to form a clear skin layer 2*c* on the surface of the vulcanized foam rubber material at a time of vulcanization and foaming by an effect of the nature of the chloropylene rubber. Therefore, it enables to enhance the wear resistance of the vibration-proof glove.

The vibration-proof glove according to the preferred embodiment of the invention can be produced with the following method. This method includes a first to sixth processes.

First, a rubber sheet 3 is made with a material which is composed of chloropylene rubber (or natural rubber) and foaming agent added in the rubber (a first process). The foaming agent to be used in this process is not limited to a particular agent but it is preferable to use "Celmike" (a product name) of SANKYO KASEI Co., Ltd.

Followed by the first process, the rubber sheet 3 is cut into a given size of a palm portion (a second process).

Figure 4:
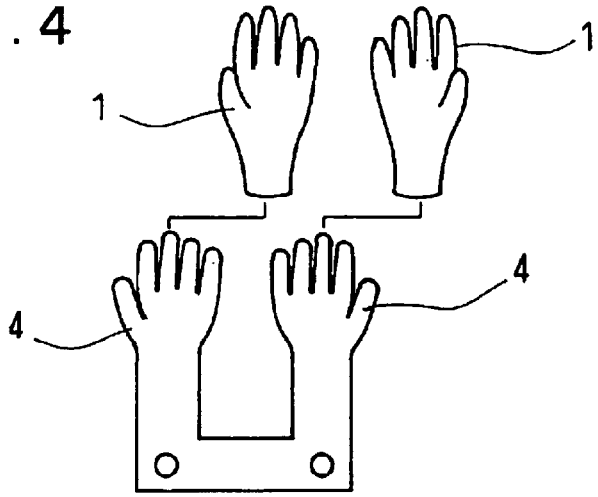
FIG. 4 is a production method of a vibration-proof glove according to a preferred embodiment of the invention, illustrating particularly an elevation view showing a process wherein a glove body is mounted over a flat hand shape mold.
Figure 5:
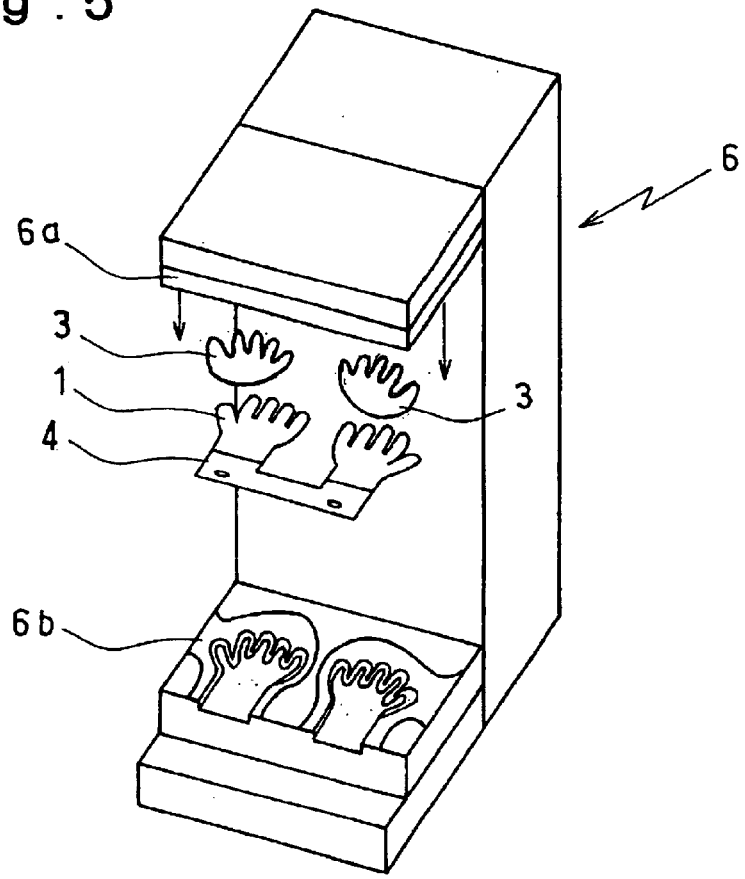
FIG. 5 is a production method of a vibration-proof glove according to a preferred embodiment of the invention, illustrating particularly a perspective view showing a process wherein a rubber sheet is attached to a glove body.

Then, as illustrated in FIGS. 4 and 5, a knit made glove body 1 is mounted over a flat hand shape mold 4, and it is placed on a lower mold 6*b* of a press machine 6 positioning the palm portion thereof upside (a third process).

Further, the rubber sheet 3 is placed on the palm portion of the glove body 1, and the rubber sheet 3 is pressed and heated by an upper mold 6*a* to attach the rubber sheet 3 to the glove body 1 (a fourth process). In this process, the pressure force of the upper mold 6*a* is 4 to 6 kg/cm$^2$ while the pressing time is 15 to 60 seconds in case a chloropylene made sheet is applied, and it is 20 to 60 seconds in case a natural rubber made sheet is applied. The pressing temperature is preferably at 60° C. to 80° C.

After completion of the fourth process, the glove body 1 is removed from the flat hand shape mold 4 and is mounted over a tridimensional type hand shape mold 5 (a fifth process).

Figure 6:
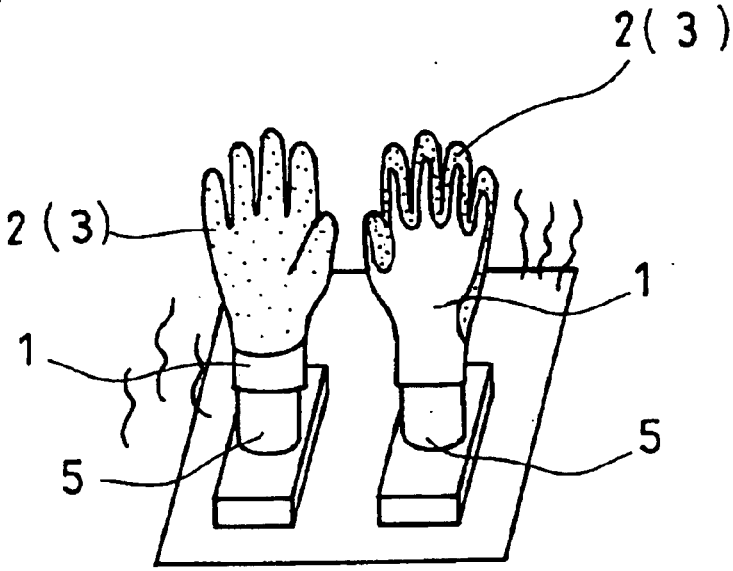
FIG. 6 is a production method of a vibration-proof glove according to a preferred embodiment of the invention, illustrating particularly a perspective view showing a process wherein a rubber sheet is vulcanized and foamed.

Then, as illustrated in FIG. 6, the rubber sheet 3 is vulcanized and foamed to increase the thickness thereof thereby providing a glove having an good effect in isolating vibrations (a sixth process).

In this process, it is possible to enlarge the thickness of the rubber sheet 3 up to 4 mm to 8 mm by setting the vulcanizing time at 50 to 60 minutes, the vulcanizing temperature at 140° C. to 150° C. and the foaming magnification of the rubber sheet 3 at 2 to 4 times.

Figure 7:
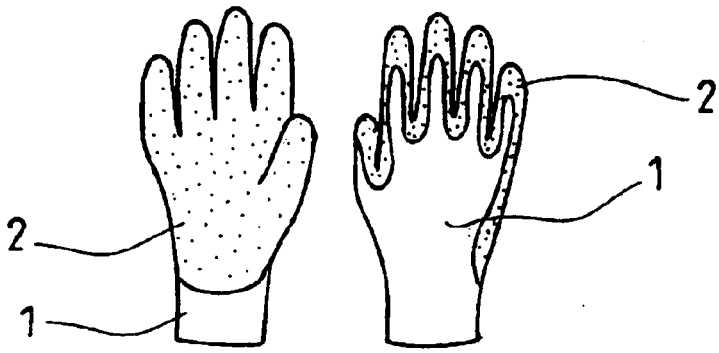
FIG. 7 is a production method of a vibration-proof glove according to a preferred embodiment of the invention, illustrating particularly a perspective view showing a finished vibration-proof glove.

Following the sixth process, as shown in FIG. 7, the vibration-proof glove is removed from the tridimensional type hand shape mold 5 to bring a finished product.

It will be noted that, as illustrated in FIG. 5, the crosswise grooves 2*a* or lengthwise grooves 2*b* are formed by such a process wherein the rubber sheet 3 is partially pressed by protrusions provided at the bottom surface of the upper mold 6*a* to form thin portions. The thin portions are less foamed compared to other thick portions during the heating and vulcanizing process and thus they remain as thin as before, forming the crosswise grooves 2*a* or length wise grooves 2*b*.

According to the production method of a vibration-proof glove, the glove can be produced merely by adding foaming agent to the chloropylene rubber (or natural rubber) to produce the rubber sheet 3, followed by attaching the rubber sheet 3 to the glove body 1 and then vulcanizing and foaming the rubber sheet 3.

For that reason, it is easy to produce a vibration-proof glove.

[Effects of the Invention]

According to the first aspect of the present invention, a vulcanized foam rubber material is provided at least at the palm portion of a stretchable glove body which is made of a knit material and the like, so that the vulcanized foam rubber functions as a vibration insulation material, thereby performing an excellent effect in isolating vibrations.

Further, the glove is composed merely of the glove body and the vulcanized foam rubber material, so that it is simple in structure and is low in production cost. Moreover, the vulcanized and foamed rubber material is flexible, thus it is easy to move a hand wearing the glove and is excellent in usability.

According to the second aspect of the present invention, which includes the similar effects of the first aspect of the invention, a plurality of crosswise grooves are provided on the vulcanized foam rubber material, so that the flexibility of the vulcanized foam rubber material can be improved. Therefore, the usability of the glove further improves.

According to the third aspect of the present invention, which includes the similar effects of the first and second aspects of the invention, a plurality of lengthwise grooves are provided on the vulcanized foam rubber material, so that the flexibility of the glove is further improved, thereby improving the usability of the glove.

According to the fourth aspect of the present invention, which includes the similar effects of the first, second and third aspects of the invention, when the vulcanized foam rubber material is made particularly of chloropylene rubber, a clean skin layer can be formed on the surface of the rubber material at a time of vulcanization and foaming.

Therefore, it is possible to enhance the wear resistance of the vibration-proof glove.

According to the fifth aspect of the present invention, the glove is produced merely by forming a rubber sheet with rubber material, which includes chloropylene rubber, natural rubber and the like, and a foaming agent which is added into the rubber material, followed by vulcanizing and foaming the rubber sheet after attaching the rubber sheet on a glove body, so that a vibration-proof glove can be easily produced.

Accordingly, the production of the glove is easy, the production cost thereof becomes lower and the productivity thereof improves.

According to the sixth aspect of the present invention, which includes the effect of the fifth aspect of the invention, the vulcanized and foamed rubber material is provided with either a plurality of the crosswise grooves or lengthwise grooves, or it is provided with both the crosswise grooves and the lengthwise grooves, so that the flexibility of the glove improves by effects of those grooves, improving the usability of the glove.

We claim:

1. A vibration-proof glove for use during operation of a vibration tool, said glove comprising:

a stretchable knit glove body including a palm portion for covering a palm of a wearer and finger portions for covering an entirety of a gripping side of fingers of the wearer;

vulcanized foam rubber vibration insulator sections provided at least on the palm portion of the glove body;

a plurality of crosswise grooves extending between the vibration insulator sections and in a direction roughly orthogonal to a direction in which the finger portions extend; and a plurality of lengthwise grooves extending between the vibration insulator sections and in a direction roughly parallel to the direction in which the finger portions extend;

wherein an area covered by the vibration insulator sections is greater than an area of said crosswise and lengthwise grooves.

2. A vibration-proof glove claimed in claim 1, wherein the vulcanized foam rubber is made of one of chloropylene rubber and natural rubber.

* * * * *

UNITED STATES PATENT AND TRADEMARK OFFICE

CERTIFICATE OF CORRECTION

PATENT NO. : 6,928,658 B2 
APPLICATION NO. : 10/813791
DATED : August 16, 2005
INVENTOR(S) : Souichirou Taira et al.

It is certified that error appears in the above-identified patent and that said Letters Patent is hereby corrected as shown below:

On the title page item [57], In the abstract, line 9, "chloropylene" should be changed to --chloroprene--.

Column 2, lines 5, 13 and 67, each occurrence of "chloropylene" should be changed to --chloroprene--.

Column 3, lines 6, 63 and 65, each occurrence of "chloropylene" should be changed to --chloroprene--.

Column 4, lines 44, 48 and 57, each occurrence of "chloropylene" should be changed to --chloroprene--.

Column 5, line 6 and 37, each occurrence of "chloropylene" should be changed to --chloroprene--.

Column 6, lines 12 and 19, each occurrence of "chloropylene" should be changed to --chloroprene--.

Claim 2, line 2, "chloropylene" should be changed to --chloroprene--.

Signed and Sealed this

Twelfth Day of December, 2006

JON W. DUDAS
*Director of the United States Patent and Trademark Office*